US005984381A

United States Patent [19]

Yamagishi

[11] Patent Number: 5,984,381

[45] Date of Patent: Nov. 16, 1999

[54] LOCKING DEVICES

[75] Inventor: Masahiro Yamagishi, Tokyo, Japan

[73] Assignee: Tokyo Magnet Ohyo Seihin Kabushiki Kaisha, Tokyo, Japan

[21] Appl. No.: 09/015,519

[22] Filed: Jan. 29, 1998

[30] Foreign Application Priority Data

Feb. 3, 1997 [JP] Japan ..... 9-020647

[51] Int. Cl.[6] ..... E05C 3/06

[52] U.S. Cl. ..... 292/45; 292/198; 292/DIG. 4; 267/158

[58] Field of Search ..... 267/158, 160; 36/27, 37, 38; 290/6, 45, 56, 71, 74, 75, 78, 79, 63, 64, 137, 157, 163, 146, 214, 216, 220, 198, DIG. 4

[56] References Cited

U.S. PATENT DOCUMENTS

| | | | |
|---|---|---|---|
| 3,994,476 | 11/1976 | van Gennep | 254/186 R |
| 4,592,153 | 6/1986 | Jacinto | 36/38 |
| 4,660,871 | 4/1987 | Arakawa et al. | 292/81 |
| 4,792,165 | 12/1988 | Nishimura | 292/19 |
| 4,917,416 | 4/1990 | Westphal et al. | 292/DIG. 4 |
| 5,004,276 | 4/1991 | Hanley | 292/DIG. 4 |
| 5,090,751 | 2/1992 | Kobayashi | 292/DIG. 4 |
| 5,217,262 | 6/1993 | Kurosaki | 292/DIG. 4 |
| 5,292,158 | 3/1994 | Kurosaki | 292/DIG. 4 |
| 5,498,039 | 3/1996 | Bivens | 292/DIG. 4 |

*Primary Examiner*—Flemming Saether
*Assistant Examiner*—Teri Pham
*Attorney, Agent, or Firm*—Liniak, Berenato, Longacre & White

[57] ABSTRACT

A locking device for opening or closing a door comprising a lock housing having a pair of holes; a slider slidable within the lock housing; a pair of clamps, the base end being pivotally mounted on the front end of the slider, and the other end having a spring force acting outward; a spring member for the clamp attached to the front end of the slider; rails each provided on the outside of the pair of clamps in the lengthwise direction; a pair of rollers each having a circular shape, which can be fitted with each of the rails, and are supported to be revolved in adjacent to the holes of the lock housing; a spring member for the slider which is intervened between the lock housing and the slider and which applies a spring force to the slider in the direction forward to the hole of the lock housing; a heart-shaped groove carved in one side of the slider, having a plurality of differences in depth, and a recess provided on the bottom portion thereof; a projecting member, one end being slidable in the groove only in one direction, and the other end being formed on the lock housing; a spring member for the projecting member; a resilient member which reinforces the resiliency of the spring member for the projecting member; and a key unit which can be clamped by the pair of clamps is provided.

2 Claims, 4 Drawing Sheets

LOCKING DEVICES

BACKGROUND OF THE INVENTION

1. Field of the Invention

The present invention relates to a locking device for opening or closing a door which is used in kitchen furniture and the like.

2. Prior Art

In conventional, there is a locking device for opening or closing a door, for example, as described in Japanese examined Utility Model Publication 2-2857 (corresponding to U.S. Pat. No. 4,482,175). The locking device disclosed therein comprises a lock housing 36, having a case 38, formed in a cabinet A for kitchen furniture and a key unit 37 formed in a door B as shown in FIG. 4. The lock housing 36 and the key unit have the relation to be fitted with each other and to be released. The lock housing 36 of the cabinet A has a pair of holes formed in the surface thereof in which a slider which can be moved 40 is accommodated. At the front end of the slider 40, a pair of clamps 41 and 41 which can revolve are supported. A spring member (not shown) is provided so that it is applied to a spring force to open the front ends of the clamps 41 and 41 in a V-shape. At the same time, a heart-shaped groove 42 is provided on the side of the slider. A projecting member 43, one end of which slides within the slider only in one direction is provided, and the other end is formed on an appropriate position of the cabinet A, is applied to a spring force in the direction of groove 42 by a leaf spring 45.

Consequently, when the door B in the closed state is opened, the clamps 41 and 41, which are opened in the rear surface of the door in a V shape, are brought into contact with each other in the state where a spherical member 47 of the key unit is intervened between the clamps. When the door B is further pushed toward the direction of the cabinet A, the clamps 41 and 41 are guided by rollers 48 and 48 to be pushed inward. The clamps 41 and 41 then revolve in the direction where the open ends thereof are closed, and they clamp the spherical member 47 and move toward the direction of the cabinet A. At this time, the front end of the projecting member 43 residing within the heart-shaped groove is positioned at the recess via one side of the groove 42 to the top of the groove, and inhibits the slide of the clamps 41 and 41. The door B is locked on the cabinet A in this state.

The locking device as described above in which the leaf spring 45 is used to apply a spring force to the heart-shaped groove is disadvantageous in terms of the durability in that when the number of using the lock device is increased, the resilient of the spring force becomes poor.

Furthermore, when the door is further pushed, the front ends of the clamps 41 and 41 are opened in a V-shape by a spring force of the spring provided on the base ends of the clamps 41 and 41 whereby the slider 40 and the clamps 41 and 41 move forward to release the locking state in the locking device disclosed therein. However, since the movement is due to the spring force of the spring provided on the base ends of the clamps 41 and 41, it is difficult to smoothly move the slider 40 and the clamps 41 and 41 forward, and their actions tend to be slow.

Moreover, it is difficult to correctly fix the spherical member 47 of the key unit in the door side at the position opposite to the lock housing 36 and, thus, there is a tendency to have some gaps between the positions of the lock housing 36 and the key unit 37.

SUMMARY OF THE INVENTION

An object of the present invention is, therefore, to provide a locking device for opening or closing a door which can open or close a door only by pushing the door with one touch of one's finger, which has an enhanced durability, which acts smoothly, and which is composed such that even when some gaps are generated, they can be automatically corrected, whereby solving the problems associated with the prior art.

The present invention, which has been achieved in light of the circumstances described above, relates to a locking device for opening or closing a door, which comprises a lock housing having a pair of holes formed in the front surface thereof; a slider which can slide within the lock housing; a pair of clamps, the base end of each of which is pivotally mounted on the front end of the slider, and the other end of each of which has a spring force acting outward; a spring member for the clamp attached to the front end of the slider such that said pair of clamps are opened in an approximately V-shape; rails each provided on the outside of said pair of clamps in the lengthwise direction; a pair of rollers each having a circular shape, which can be fitted with each of the rails, and are supported to be revolved in adjacent to the holes of the lock housing; a spring member for the slider which is intervened between said lock housing and said slider and which applies a spring force to said slider in the direction forward to the hole of the lock housing; a heart-shaped groove which is carved in one side of said slider, has a plurality of differences in depth, and a recess provided on the bottom portion of the heart shape; a projecting member, one end of which can slide in the groove only in one direction, and the other end of which is formed on an appropriate position of the lock housing; a spring member for the projecting member formed on the lock housing, which applies a spring force to said projecting member in the groove direction; a resilient which is intervened between the spring member for the projecting member and the lock housing and reinforces the resiliency of said spring member for the projecting member; and a key unit having a spherical member, which can be clamped by the pair of clamps.

The locking device according to the present invention is also characterized in that said resilient is made of a synthetic resin.

The locking device according to the present invention is also characterized in that the spherical member of the key unit can moved within a prescribed range in the direction perpendicular to the direction of the movement of the spherical member.

PREFERRED EMBODIMENTS OF THE INVENTION

In the following, embodiments of the locking device according to the present invention will now be described by referring to the attached drawings.

Figure 1:
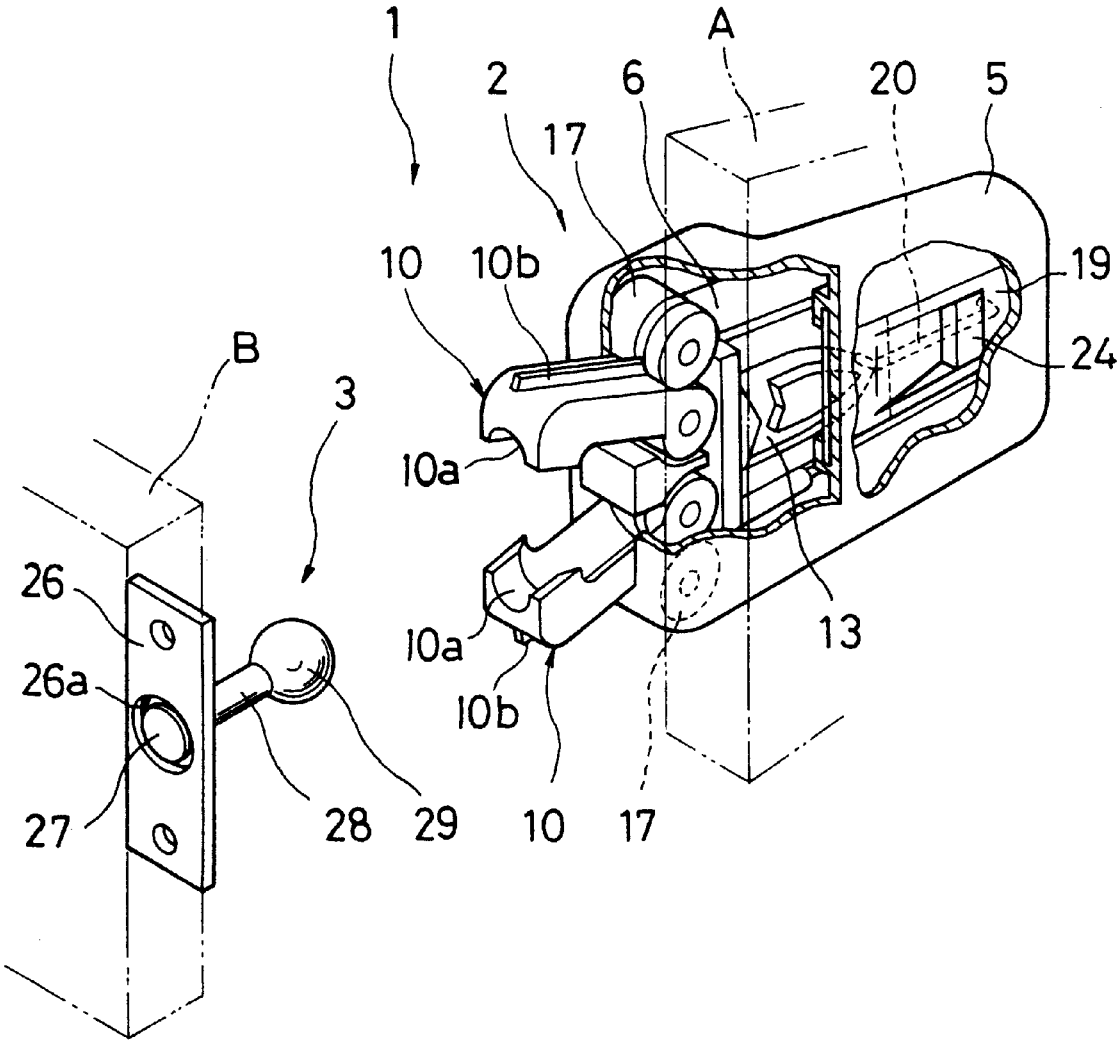
FIG. 1 is a perspective view showing a locking device according to one embodiment of the present invention.
Figure 2:
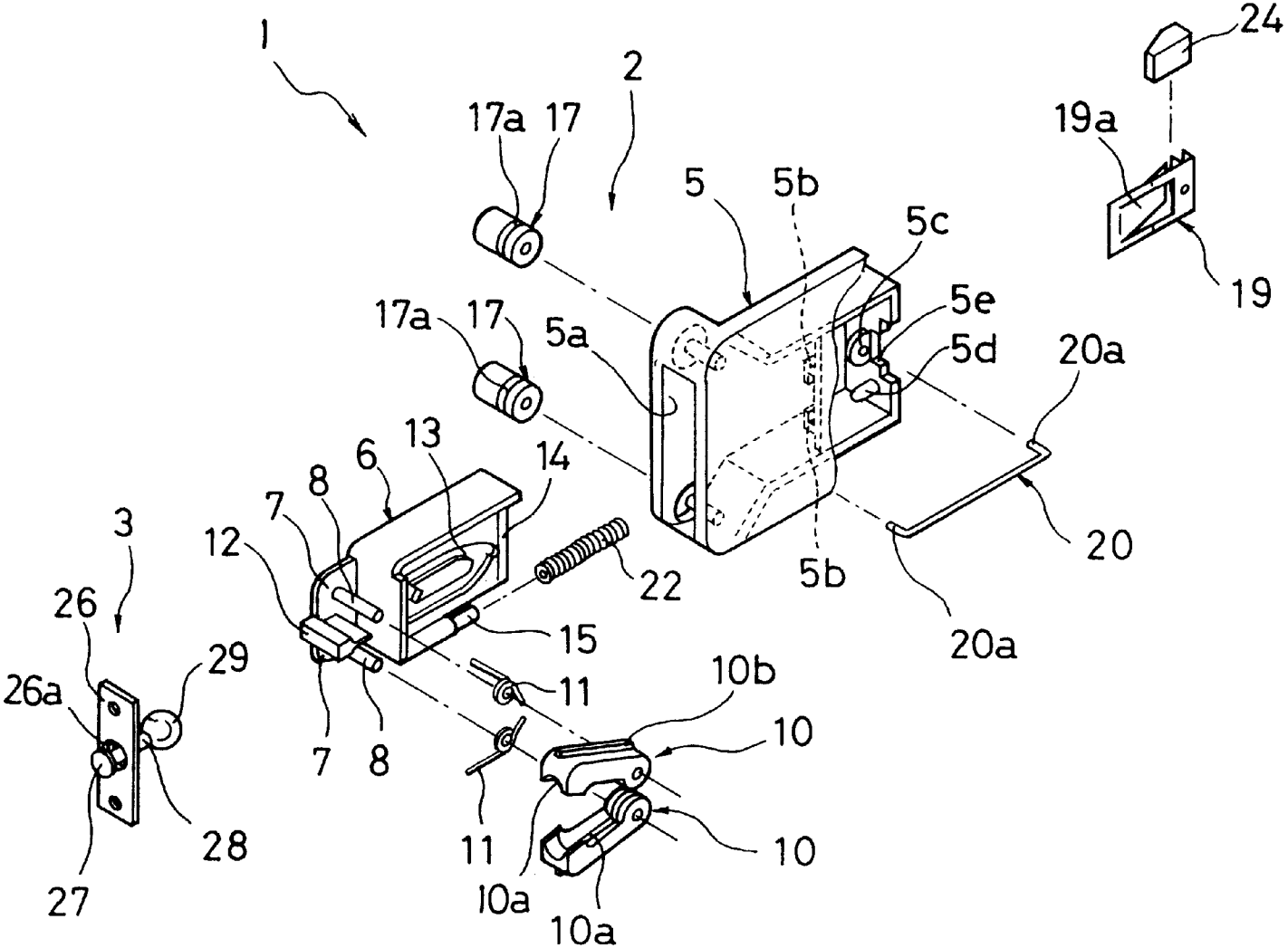
FIG. 2 is an exploded perspective view showing a locking device of FIG. 1.

FIG. 1 is a perspective view showing one embodiment of a locking device according to the present invention, and FIG. 2 is an exploded view thereof. As shown in FIGS. 1 and 2, a locking device 1 for opening or closing a door comprises a locking housing 2 equipped on the side of a cabinet A and a key unit 3 equipped on the side of a door B.

The lock housing 2 has a box case 5 made of a synthetic resin. The front surface of the case 5 is opened, and within the case 5 a slider 6 which can slide in the front and rear directions is stored.

Dented portions 7 and 7 provided on the top and the bottom of the front end of the slider 6 are supported by the base ends of a pair of clamps 10 and 10 which can vertically revolve. Hallow portions 10*a* and 10*a* are provided opposite to the front ends of the clamps 10 and 10. Rails 10*b* and 10*b* are provided along the rear surfaces of the clamps 10 and 10 over approximately entire length so that by a spring force of spring members 11 and 11, the front ends of the both clamps 10 and 10 are opened approximately in the V-shape.

Between pins 8 and 8 of the slider 6, the sharpened tip 12 having a triangle structure and the sharpened tip in the rear side is provided. On one side of either right or left of the slider 6 a groove 13 having a heart shape contour is carved. On a back of the heart-shaped groove 13, a slope 14 is provided. On the down side of the heart-shaped groove 13, a spring receiver is provided such that the front end is directed backward.

On the upper and lower portions of the front end within the case 5, rollers 17 and 17 are supported pivotally, and the rollers 17 and 17 have a annular grooves 17*a* and 17*a* in the middle position thereof. The annular grooves 17*a* and 17*a* can be fitted with rails 10*b* and 10*b* of the clamps 10 and 10. When the slider is moved backward within the case 5, the slider 6 pushes the clamps 10 and 10 from outward to inward at which the free end thereof is closed.

The case 5 has an open hole 5*a* positioned at the front, a pair of holding portions 5*b* and 5*b* which are provided opposite to the heart-shaped groove 13 of the slider 6 in order to hold a leaf spring 19 described latter on, a supporting member 5*c* for supporting a projecting member 20 which can revolve, a spring receiver 5*d* provided on the lower portion of the supporting member 5*c* whose top end is faced toward the front, and an insert hole 5*e* perforated at the rear end thereof for inserting a leaf spring 19. A coil spring 22 is compressed between the spring receiver 5*d* and the slider 6.

The projecting member has a U-shape and possesses bent portions 20*a* and 20*a* at the both ends thereof. The bent portion 20*a* at one end is supported by the supporting member 5*c* for supporting a projecting member so as to freely revolve, and the bent portion 20*a* at the other end is always in contact with the heart-shaped groove by a spring force of the leaf spring 19.

The leaf spring 19 is cut to form a bent portion 19*a* having a rectangle shape. There is a triangle resilient member 24 made of silicone sandwiched between the bent portion 19*b* and the base of the leaf spring 19.

The resilient member 24 plays a role in a cushion for the projecting member 20 whereby the resiliency and durability of the leaf spring 190 can be significantly improved. The durability of the locking device can be improved approximately 10 times as compared with that having no resilient member.

Figure 3A:
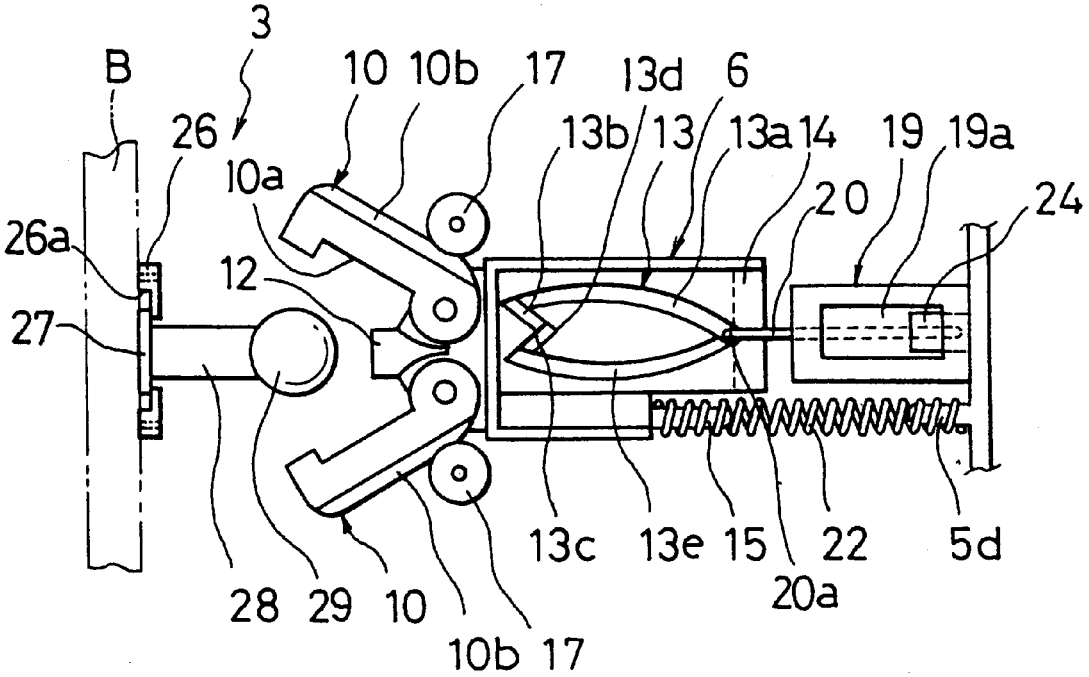
FIGS. 3A & 3B are side views respectively showing the action of the locking device of FIG. 1 in an opened and closed state.
Figure 3B:
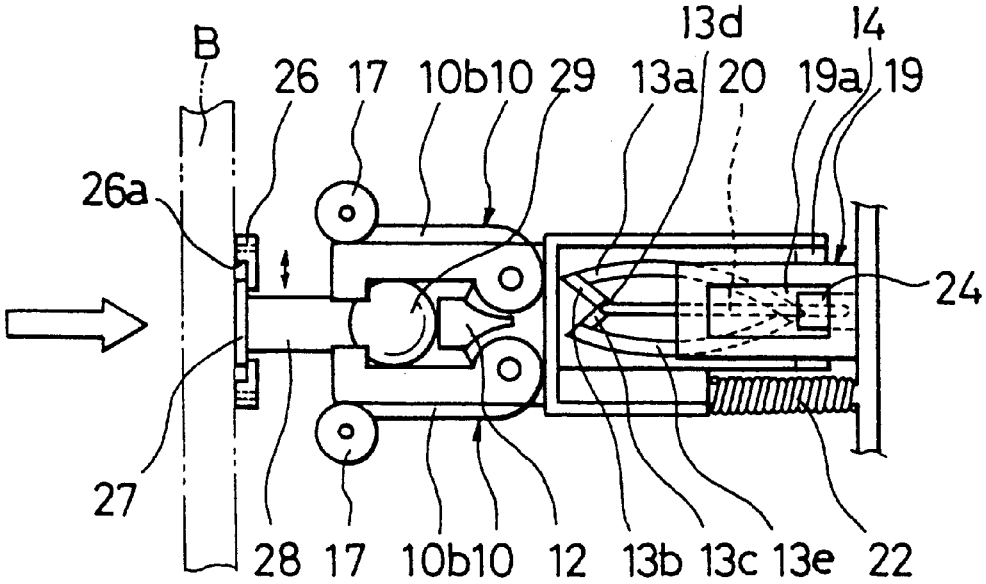
Figure 4:
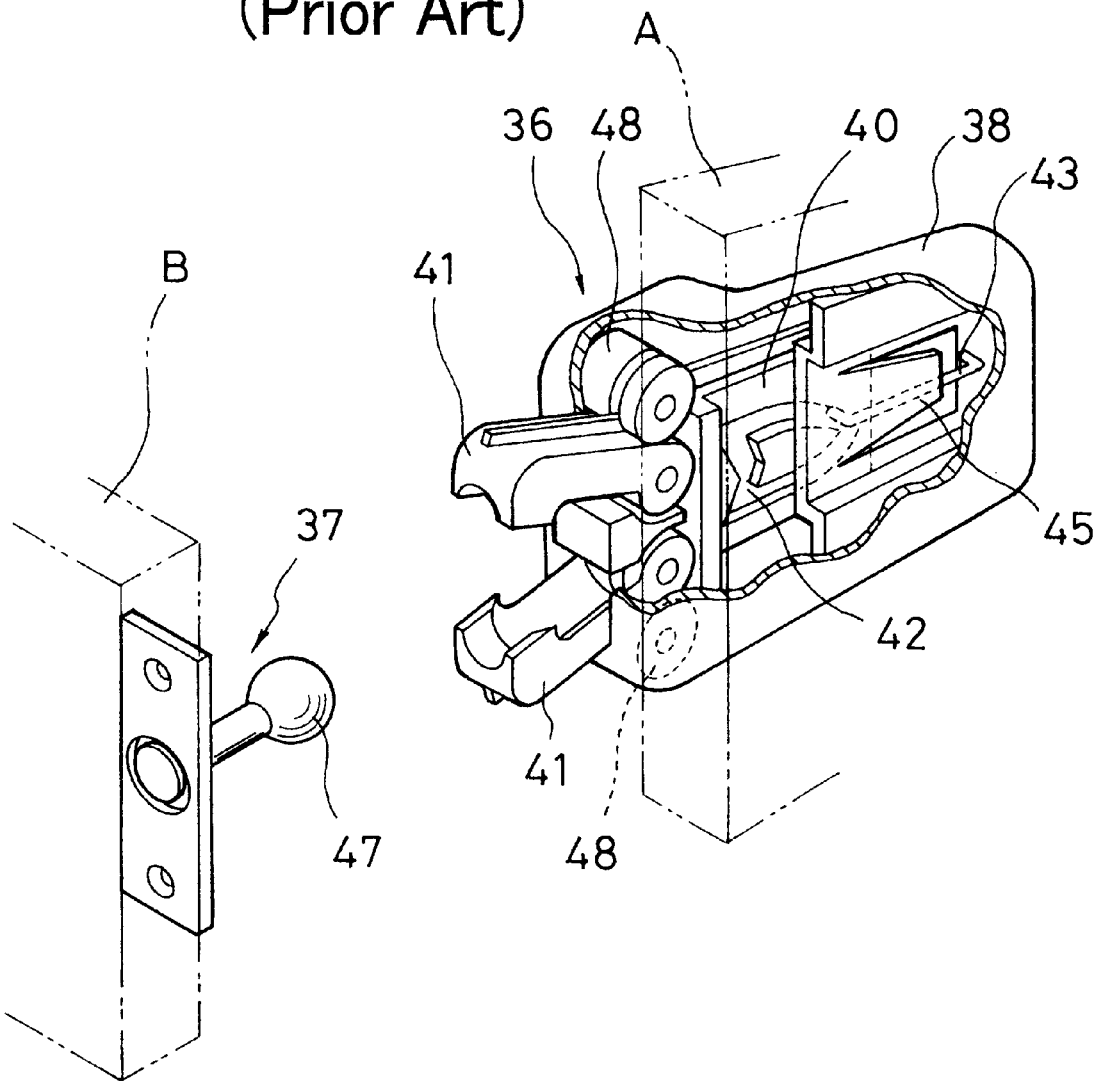
FIG. 4 (Prior Art)
FIG. 4 is a perspective view showing a locking device according to the prior art.

As shown in FIGS. 3A & 3B, the heart-shaped groove 13 is formed from a top portion 13*a*, a pair of slopes, i.e., a downward slope 13*b* and an upward slope 13*c*, a recess 13*d* which is a bottom of the slopes, and bottom portion 13*e*. There are differences in the depth from the rear end of the top portion 13*a* to the front end of the bottom portion 13*e*, from the top portion 13*a* to the downward slope 13*b*, from the downward slope 13*b* to the recess 13*d*, and from the upward slope 13*c* to the bottom portion 13*e*. There is no difference in depth between the recess 13*d* and the upward slope 13*c*. The depth in the bottom portion 13*e* is gradually decreased from the front end to the rear end. There is also difference in depth between the rear end of the bottom portion 13*e* to the rear end of the top portion 13*a* so that the depth in the bottom portion side is deep. Consequently, due to the differences in depth described above, the bent portion 20*a* of the projecting member can slide in the direction of from the top portion 13*a*, the downward slope 13*b*, the recess 13*d*, the upward slope 13*c*, the bottom portion 13*e*, to the top portion 13*a*, but it cannot slide in the reverse direction.

On the other hand, as shown in FIGS. 1 and 2, a key unit 3 is mounted opposite to the lock housing 2 residing on the rear surface of the door B of kitchen furniture. The key unit 3 has a base plate 26 to be installed to the door B. The base plate 26 has a circular groove 26*a* at the center portion thereof. The circular groove 26*a* has a penetrating pore. Further, a disk 27 having a diameter smaller than that of the circular groove 26*a* is slidably fitted within the groove 26*a* of the base plate 26. A rod 28 having a diameter smaller than the penetrating pore of the circular groove 26*a* is mounted on the disk 27. On the front end of the rod 28, a spherical member 29 is fixed. Accordingly, the disk 27, the rod 28, and the spherical member 29 can be moved within the penetrating pore of the circular groove 26*a*, making it possible to automatically correct the position of mounting the key unit 3 and the lock housing 2, even if the positions to be communicated have some gaps.

Next, the action of the locking device for opening or closing a door according to the present invention will be described by referring to FIGS. 3A & 3B.

FIG. 3 (A) shows the lock housing and the key unit which are opened. The slider 6 and the clamps 10 and 10 are at forward position by the action of the coil spring 22. The front ends of the clamps 10 and 10 are opened, and the bent portion 20*a* of the projecting member 20 resides at the portion backward to the top portion 13*a* of the heart-shaped groove 20.

As shown in FIG. 3 (*b*), when the door B in the open state is closed, the spherical member 29 of the key unit 3 pushes the top end 12 of the slider 6 thereby backing the slider 6 and the clamps 10. According to the movement, the rollers 17 and 17 pushes the clamps 10 and 10 from outward to inward to compress the open end thereby clamping the spherical member 29 by the dented potions 10*a* and 10*a*. At the same time, the bent portion 20*a* of the projecting member 20 slides to the recess 13*d* of the heart-shaped groove 13 via the top portion 13*a* and the downward slope 13*b* so that the bent portion of the projection member 20 is locked at the position of the recess 13*d* by a resilient force. In this case, the projecting member 20 is always applied to a spring force by the leaf spring 19 and the resilient 24. At the same time, since the slope 14 at the rear end of the slider 6 is in contact with the bent portion 19*a* of the leaf spring and is applied to a pressure, the projecting member 20 is more strongly applied to the spring force in the direction of the heart-shaped groove 13 by a resilient force of the leaf spring and the resilient 24. In this state, the door B is in locked state.

On the other hand, since the disk 27, the rod 28 and the spherical member 29 of the key unit 3 can slide perpendicular to the direction of the movement of the spherical member 29, it is possible to automatically correct the position of mounting the key unit 3 and the lock housing 2, even if the positions to be communicated have some gaps.

When the door B in the closed state is further pushed, the bent portion 20*a* of the projecting member 20 is moved to the bottom portion 13*e* of the heart-shaped groove 13 via the recess 13*d* and the upward slope 13*c*. By the resilient force of the coil spring 22, the slider 6 and the clamps 10 and 10 go forward. According to this movement, the front ends of the clamps 10 and 10 are released to cancel the communication relationship with the spherical member 29, i.e., to cancel the locking and to return to the state shown in FIG. 3 (A) whereby the door B becomes an open state. In this case, the bent portion 20*a* of the projecting member 20 slides from the recess 13*d* of the heart-shaped groove 13 to the rear end of the top portion 13*a* via the upward slope 13*c* and the bottom portion 13*e,* and stops at this position.

Consequently, the projecting member 20 is applied to a spring force in the heart-shaped groove direction by the leaf spring 19 and the resilient 24. The resilient 24 can significantly improve the resiliency and durability of the leaf spring 19.

Moreover, since the coil spring 22 is intervened between the slider 6 and the case 5, the slider 6 and the clamps 10 and 10 can rapidly remove, making it possible to rapidly cancel locking.

Whereas the locking device for opening or closing a door in the embodiment described above is applied to a door for kitchen furniture, the device of the present invention is, of course, applicable to another furniture.

Whereas the locking housing and the key unit of the locking device in this embodiment are mounted in the vertical direction, they can be, of course, mounted in the horizontal direction.

Further, while silicone is used as the resilient, another resilient such as synthetic resin or rubber is, of course, used as the resilient.

As described above, according to the present invention, the projecting member is always applied to a spring force in the heart-shaped groove direction by the spring member for the projecting member. Since a resilient is intervened between the case of the lock housing and the spring member for the projecting member, by the use of the resilient, the resiliency and durability of the spring member for the projecting member can be significantly improved.

Moreover, a spring member for the slider is intervened between the slider and the lock housing, the slider and the clamps can rapidly remove, making it possible to rapidly cancel locking.

Further, the spherical member of the key unit can slide in the direction perpendicular to the vertical movement of the spherical member, it is possible to automatically correct the position of mounting the key unit and the lock housing, even if the positions to be communicated have some gaps.

What is claimed is:

1. A locking device for opening and closing a door, which comprises:

a lock housing having a pair of holes formed in a front portion thereof;

a slider which can slide within the lock housing;

a pair of clamps, a base end of which is pivotally mounted on a front end of the slider, and an opposite end of each of which has a spring force acting outward;

a spring member for the clamp attached to the front end of the slider such that said pair of clamps are opened in an approximately V shape;

rails each provided on the outside of said pair of clamps in a lengthwise direction;

a pair of rollers each having a circular shape, which can be fitted with each of the rails, and are supported to be revolved in the holes of the lock housing;

a spring member for the slider which is intervened between said lock housing and said slider and which applies a spring force to said slider in the direction forward to the holes of the lock housing;

a heart-shaped groove which is carved in one side of said slider, has a plurality of differences in depth, and a recess provided on the bottom portion of the heart-shaped groove;

a projecting member, one end of which can slide in the groove only in one direction, and the other end of which is formed on an appropriate position of the lock housing;

a spring member for the projecting member formed on the lock housing, which applies a spring force to said projecting member in the groove direction;

a resilient member which is intervened between the spring member for the projecting member and the lock housing and reinforces the resiliency of said spring member for the projecting member; and a key unit having a spherical member, which can be clamped by the pair of clamps.

2. The locking device as claimed in claim 1, wherein the spherical member of the key unit can be moved within a prescribed range in the direction perpendicular to the direction of the movement of the spherical member.

* * * * *